US010465342B2

(12) United States Patent
Buschman

(10) Patent No.: US 10,465,342 B2
(45) Date of Patent: Nov. 5, 2019

(54) HINGE/TAPER CLAMP ROD HOLDER INSERT

(71) Applicant: Westlake David Buschman, Willoughby Hills, OH (US)

(72) Inventor: Westlake David Buschman, Willoughby Hills, OH (US)

(73) Assignee: Buschman Corporation, Cleveland, OH (US)

( * ) Notice: Subject to any disclaimer, the term of this patent is extended or adjusted under 35 U.S.C. 154(b) by 1 day.

(21) Appl. No.: 15/844,969

(22) Filed: Dec. 18, 2017

(65) Prior Publication Data

US 2018/0105989 A1 Apr. 19, 2018

Related U.S. Application Data

(63) Continuation-in-part of application No. 13/961,061, filed on Aug. 7, 2013, now Pat. No. 9,869,061.
(Continued)

(51) Int. Cl.
*B05C 11/02* (2006.01)
*D21H 25/06* (2006.01)
(Continued)

(52) U.S. Cl.
CPC ..... *D21H 25/06* (2013.01); *B05C 1/0817* (2013.01); *B05C 11/025* (2013.01); *D21G 3/00* (2013.01);
(Continued)

(58) Field of Classification Search
CPC ... B05C 1/0817; B05C 1/0834; B05C 11/025; B05C 11/044; B05C 11/021;
(Continued)

(56) References Cited

U.S. PATENT DOCUMENTS 4,367,691 A 1/1983 Bergs
6,911,085 B2 6/2005 Knop
(Continued)

FOREIGN PATENT DOCUMENTS

EP 1 485 209 12/2004
EP 2341185 A1 7/2011
(Continued)

OTHER PUBLICATIONS

International Search Report and Written Opinion, dated May 29, 2018, in connection with International Application No. PCT/US2018/016946, filed Feb. 6, 2018.

*Primary Examiner* — Laura Edwards
(74) *Attorney, Agent, or Firm* — Fay Sharpe LLP

(57) ABSTRACT

A metering rod holder assembly for supporting a metering rod in compressive engagement with a surface from which a fluid is to be metered. The rod holder assembly includes a base member having a channel opening to a first face thereof, and a rod bed insert at least partially received in the channel of the base member in spaced relation to a base wall of the channel. The rod bed insert includes a metering rod slot for receiving a metering rod, and a flank engaging surface engaged with at least one flank surface of the base member, the rod bed insert movable from a first position to a second position within the channel.

11 Claims, 12 Drawing Sheets

Related U.S. Application Data

(60) Provisional application No. 61/681,397, filed on Aug. 9, 2012, provisional application No. 62/509,341, filed on May 22, 2017.

(51) Int. Cl.

| | |
|---|---|
| ***D21G 3/04*** | (2006.01) |
| ***D21G 3/00*** | (2006.01) |
| ***D21H 25/12*** | (2006.01) |
| ***B05C 1/08*** | (2006.01) |
| *B05C 11/04* | (2006.01) |

(52) U.S. Cl.
CPC ..... *D21G 3/005* (2013.01); *D21G 3/04* (2013.01); *D21H 25/12* (2013.01); *B05C 1/0834* (2013.01); *B05C 11/021* (2013.01); *B05C 11/044* (2013.01)

(58) Field of Classification Search
CPC ..... D21H 25/06; D21H 25/12; D21G 3/00; D21G 3/005; D21G 3/04
USPC ..... 118/110, 123, 126, 262, 414; 15/256.5, 15/256.51, 256.52; 162/281; 101/120
See application file for complete search history.

(56) References Cited

U.S. PATENT DOCUMENTS

| | | | | |
|---|---|---|---|---|
| 7,798,093 | B2 | 9/2010 | Kautto et al. | |
| 8,028,648 | B2 | 10/2011 | Karusalmi et al. | |
| 2002/0138076 | A1* | 9/2002 | Biedermann ..... | A61B 17/7032 606/308 |
| 2013/0008373 | A1 | 1/2013 | Rousu | |
| 2014/0041577 | A1 | 2/2014 | Buschman | |

FOREIGN PATENT DOCUMENTS

| | | | |
|---|---|---|---|
| EP | 2712960 | A1 | 4/2014 |
| WO | WO 2007/063183 | A1 | 6/2007 |
| WO | WO 2010/142513 | | 12/2010 |

* cited by examiner

HINGE/TAPER CLAMP ROD HOLDER INSERT

CROSS REFERENCE TO RELATED PATENTS AND APPLICATIONS

The present application is a continuation-in-part of currently U.S. patent application Ser. No. 13/961,061, filed on Aug. 7, 2013, now U.S. Pat. No. 9,869,061, which claims priority to U.S. Provisional Patent Application Ser. No. 61/681,397, filed on Aug. 9, 2012, the entire contents of both applications being incorporated herein by reference. The present application also claims priority to U.S. Provisional Patent Application Ser. No. 62/509,341, filed on May 22, 2017, the entire contents being incorporated herein by reference.

BACKGROUND

The present application relates to the general field of paper, film and foil coating manufacturing and converting. It relates in particular to metering rod holder assemblies used in the coating of papers, films and foils during various coating processes.

During the coating process, a coating or metering rod holder assembly lays against a high speed transfer roller. A generous chemical coating is applied to the transfer roller. Excess coating is removed by the metering rod holder assembly leaving only a thin film of chemical treatment or coating on the transfer roller. Then the coating is transferred to a web of material, such as paper, for example. In some instances, an excess amount of coating is applied directly to the web and then the excess is removed with the metering rod.

The metering rod holder assembly includes a body having a rod channel (rod holder) that is designed to receive a metering rod (sometimes referred to as a doctor blade). The metering rod is generally, but not always, small in diameter and can be very long in length (e.g., up to 15 meters). During the coating process, the metering rod primarily controls the coating film thickness. In addition, the rod is rotated within the rod channel to provide uniform wear along the circumference of the rod.

Both metering rods and rod holders are wear parts that have service lives, depending on the application, anywhere from a few hours to a few months. The part of the rod holder that typically wears out is called a cradle and includes the rod channel in which the metering rod rotates. As the metering rod rotates, friction between the metering rod and the cradle, combined with sometimes abrasive coatings and other factors, causes the "lips" of the rod holder cradle to wear down.

In some instances, the cradle is included in an insert that is received in the body of the rod assembly. Such inserts allow replacing the cradle without having to replace the entire body resulting in a cost savings to the customer. Known metering rod assemblies utilizing an insert have generally required replacement of a conventional body with a body designed to accommodate an insert. A body configured to accommodate an insert generally will include one or more features designed to enable clamping the insert in the body to reduce or eliminate vibration and/or unintended separation of the insert from the body. For example, pneumatic clamping tubes are often supported by the body and used for securing an insert in a channel or groove of the body. Such clamping tubes can be pressurized to achieve a variable clamping effect on a metering rod.

While metering rod assemblies utilizing inserts and clamping pressure tubes have met with commercial success, the addition of clamping pressure tubes to the metering rod assemblies complicates the device, increases cost, and can result in an increased risk of operator errors or equipment failure. In addition, upgrading a metering rod holder assembly to accommodate an insert with the variable clamping features described above typically requires replacing the body of the assembly with a body equipped with a clamping pressure tube, and plumbing pneumatic lines to the body to inflate the pressure tube, and a control unit. This increases costs and complexity of metering rod assemblies.

BRIEF DESCRIPTION

The present disclosure sets forth a metering rod holder assembly including a body for accommodating a metering rod insert and configured to clamp the metering rod and/or metering rod insert without the use of an auxiliary clamping device, such as a pressure tube or the like.

In accordance with one aspect, a metering rod holder assembly for supporting an associated metering rod in compressive engagement with an associated surface from which a fluid is to be metered comprises a base member having a channel opening to a first face thereof and having a base wall and first and second side walls spaced about a central plane of the channel, at least one of the side walls having a flank surface extending at a non-zero angle relative to the central plane, and a rod bed insert at least partially received in the channel of the base member in spaced relation to the base wall of the channel, the rod bed insert having a metering rod slot for receiving the associated metering rod, and further including a flank engaging surface thereof engaged with the at least one flank surface, the rod bed insert movable from a first position to a second position within the channel, wherein the rod bed insert is closer to the base wall of the channel when in the second position than when in the first position.

At least one of the first and second side walls of the channel, or a portion thereof, can extend at a non-zero angle relative to the central plane of the channel in a taper fit manner, whereby as the metering rod urges the rod bed insert deeper into the channel the first and second side walls of the base member clamp the rod bed insert in the channel. The rod bed insert can be configured to be closely received in the channel, the first and second side walls of the insert having a mating shape to the first and second side walls of the channel. At least one of the flank surface of the base member or the flank engaging surface of the rod bed insert can include a relieved flank region. The rod bed insert can be spaced apart from the flank surface of the base member at the relieved flank region. A plurality of relieved flank regions can be spaced along a length of the metering rod holder assembly, including opposite end portions of the metering rod holder assembly. The assembly can further comprise a pressure hose disposed in the channel between the base wall and the rod bed insert for urging the rod bed insert outwardly from the channel. The rod bed insert can include at least one retaining element adapted to cooperate with a corresponding retaining element of the base member to restrict separation of the metering rod insert from the base member in both the first position and the second position. The retaining elements can include at least one protrusion and at least one recess into which the protrusion is received. At least one of the base member or the rod bed insert can be comprised of a resilient material. The flank engaging surface can be a portion of a jaw extending from a main body portion of the rod bed insert, the rod bed insert including a longitudinally extending slot between the main body portion and the jaw for allowing the jaw to flex as the rod bed insert is urged into the channel.

In accordance with another aspect, a rod bed insert is adapted to move relative to an associated base member to provide a consistent radial clamping pressure on and associated metering rod as the rod bed insert wears during use, the rod bed insert configured to be received in a channel of the associated base member, wherein the rod bed insert has a metering rod slot for receiving the associated metering rod, and includes a flank engaging surface for engaging a corresponding flank surface of the associated base member, the rod bed insert movable from a first position to a second position within the channel, wherein the rod bed insert is closer to the base wall of the channel when in the second position than when in the first position.

The flank engaging surface can include a relieved flank region. The rod bed insert can be spaced apart from the flank surface of the associated base member at the relieved flank region. The insert can further comprise a plurality of relieved flank regions spaced along a length of the flank engaging including at opposite end portions of the rod bed insert.

In accordance with another aspect, a base member of a metering rod holder assembly comprises a channel opening to a first face thereof for receiving an associated rod bed insert, the channel having a base wall and first and second side walls spaced about a central plane of the channel, at least one of the side walls having a flank surface extending at a non-zero angle relative to the central plane, wherein the associated rod bed insert can be at least partially received in the channel of the base member in spaced relation to the base wall of the channel.

At least one of the first and second side walls of the channel can extend at a non-zero angle relative to the central plane of the channel in a taper fit manner. The flank surface of the base member can include a relieved flank region. The associated rod bed insert can be spaced apart from the flank surface of the base member at the relieved flank region when received in the channel. The flank surface can include a plurality of relieved flank regions spaced apart along a length of the base member, including at opposite end portions of the base member.

BRIEF DESCRIPTION OF THE DRAWINGS

The following is a brief description of the drawings, which are presented for the purpose of illustrating the exemplary embodiments disclosed herein and not for the purpose of limiting the same.

DETAILED DESCRIPTION

Figure 1:
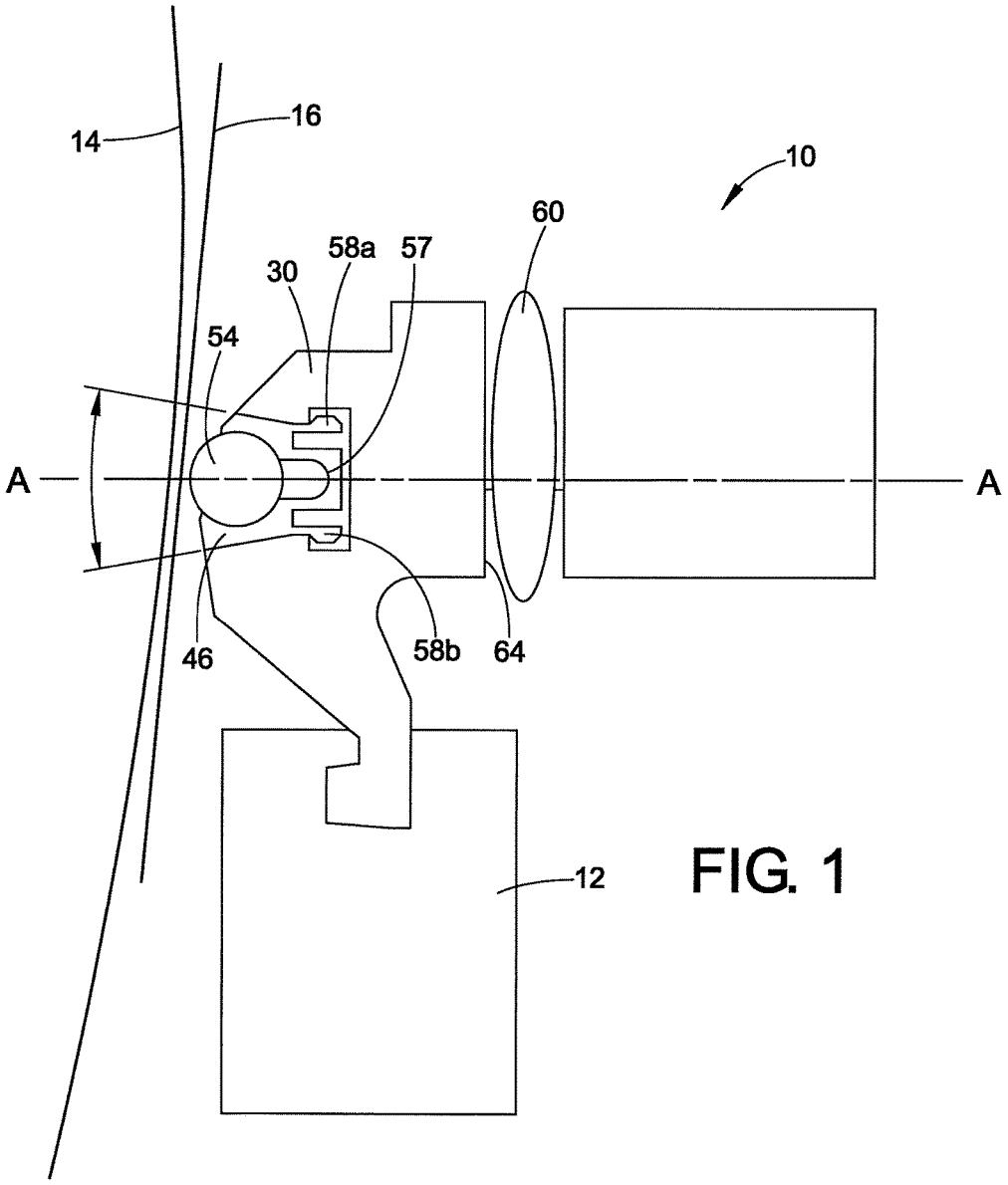
FIG. 1 is a cross-section of an exemplary metering rod holder assembly in accordance with the present disclosure.

With reference to FIG. 1, a metering rod holder assembly is illustrated and identified generally by reference numeral 10. The metering rod holder assembly 10 is illustrated as a component of a machine for applying a coating to paper during a paper manufacturing process. It will be appreciated that the metering rod holder assembly 10 is supported by a support 12 adjacent a roller 14 which advances a web of paper 16 between the metering rod holder assembly 10 and the roller 14. Although not shown, it is well known that an applicator is generally provided upstream of the metering rod holder assembly 10 for applying a coating liquid to the web 16. The coating is applied in excess and the metering rod holder assembly 10 is utilized to remove excess coating from the web 16 to achieve a desired coating thickness. The metering rod holder assembly 10 generally includes a base member 30 that is mounted to the support 12.

Figure 2:
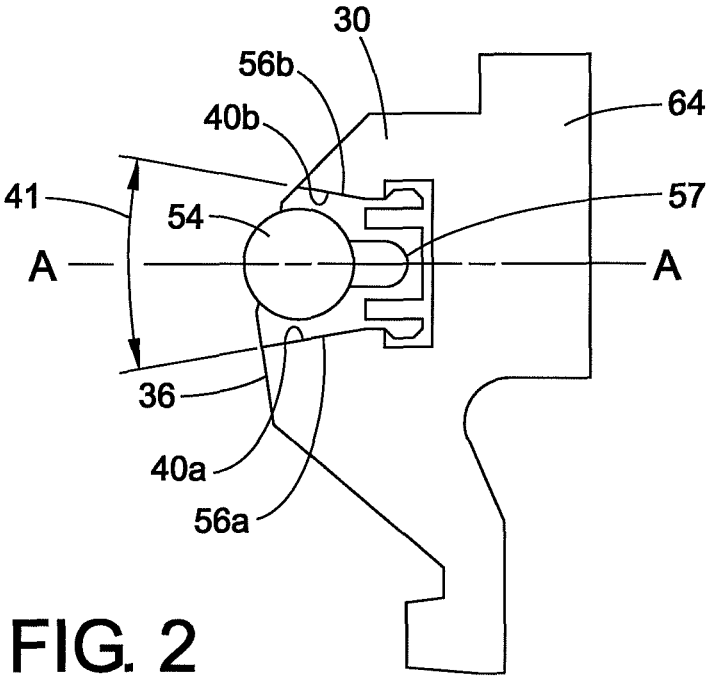
FIG. 2 is a cross-sectional view of a portion of the metering rod holder assembly of FIG. 1.
Figure 3:
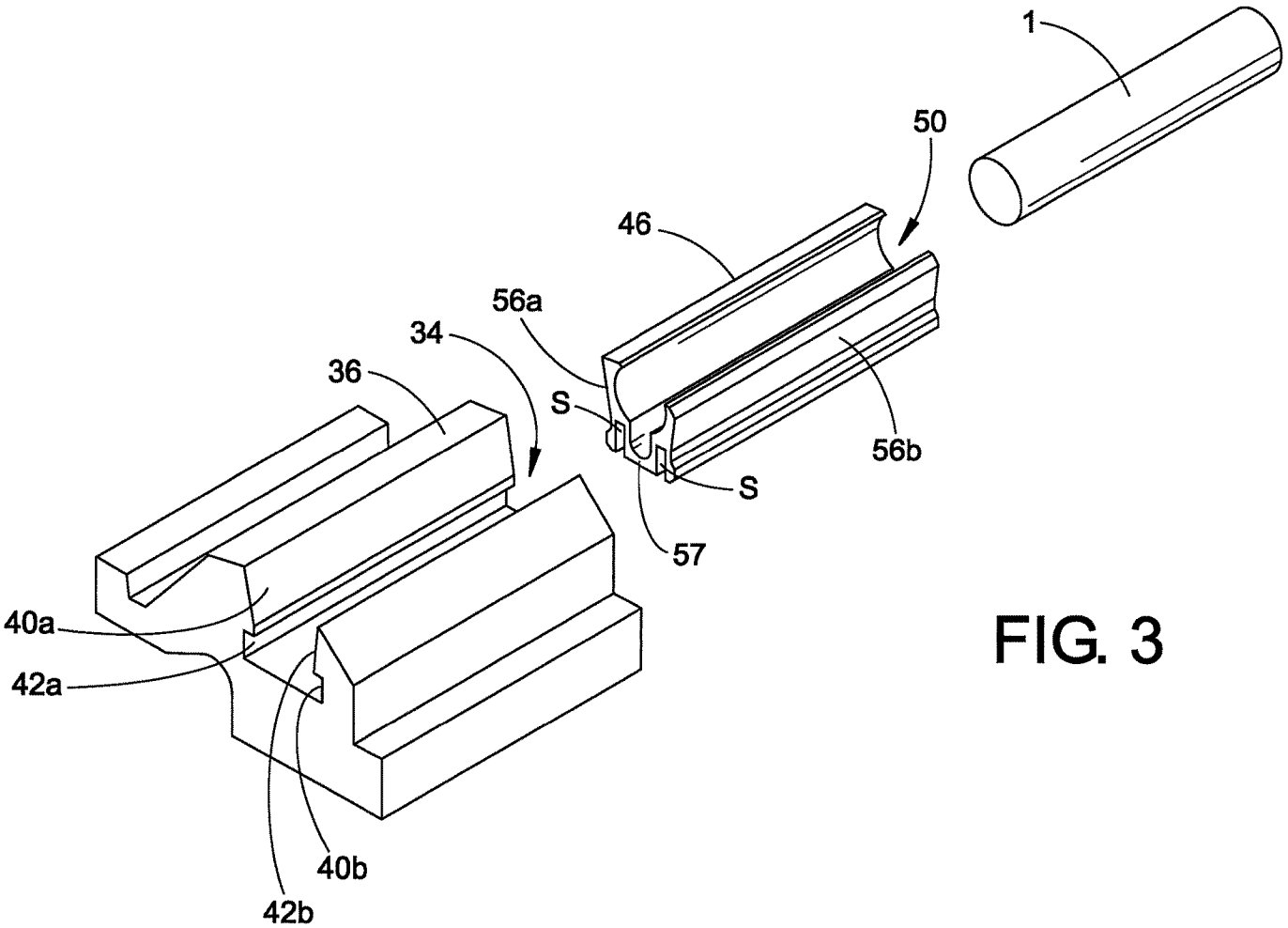
FIG. 3 is an exploded perspective view of several components of the exemplary metering rod holder assembly.

With additional reference to FIGS. 2 and 3, the base member 30 includes a channel 34 opening to a face or surface 36 thereof. The channel is generally defined by first and second sidewalls 40*a* and 40*b* that are spaced about a central plane A-A of the channel 34. In this embodiment, the first and second side walls 40*a* and 40*b* of the channel 34 extend at a non-zero angle 41 relative to a central plane A-A of the channel 34 such that the mouth of the channel 34 is wider than a base portion of the channel 34. The channel 34 further includes upper and lower retention slots 42*a* and 42*b* for receiving corresponding retention elements on a rod bed insert, as will be described below.

A rod bed insert 46 is received in the channel 34 and includes a metering rod slot 50 in which a metering rod 54 is supported. The rod bed insert 46 is configured to be closely received within the channel 34, with first and second sidewalls 56*a* and 56*b* of the insert 46 have a mating shape and slope to the first and second side walls 40A and 40B of the channel 34. The rod bed insert 46 includes a narrow or necked-down portion 57 connecting the first and second sidewalls 56*a* and 56*b* allowing the insert 46 to flex about the necked-down portion 57 to accommodate insertion and/or removal of the metering rod 54 from the metering rod slot 50.

The rod bed insert 46 includes a pair of tab portions 58*a* and 58*b* that serve as retaining elements when the rod bed insert 46 is inserted in the channel 34. As best seen in FIGS. 1 and 2, the retention tabs 58*a* and 58*b* extend into corresponding retention slots 42*a* and 42*b* at the base of the channel 34. Once the tabs 58*a* and 58*b* are secured in the slots 42*a* and 42*b*, the interference between the tabs 58*a* and 58*b* and the base member 30 restricts withdrawal of the rod bed insert 46 from the channel 34.

Returning to FIG. 1, a pressure tube 60 is supported adjacent the base member 30 and configured to apply a force along the plane A-A to place the metering rod 54 in compressing engagement with the roller 14, as is conventional. In the illustrated embodiment, the pressure tube 60 acts along the plane A-A. The pressure tube 60 can also be configured to apply pressure along a plane offset from the plane A-A. Unlike prior art metering rod assemblies, a single pressure tube is utilized to not only place the metering rod 54 into compressive engagement with the roller 14, but also to clamp the metering rod 54 and/or rod bed insert 46 in the base member 30.

To this end, it will be appreciated that when force is applied to a rear surface 64 of the base member 30, the force is transmitted through the base member 30 and rod bed insert 46 to the metering rod 54. A reactive force is applied to the metering rod 54 by the roller 14 which tends to force the metering rod 54 deeper into the rod bed insert 46. The net effect is that surfaces 40*a* and 40*b* are urged towards each other thereby clamping the rod bed insert 46 and/or metering rod 54 in the channel 34 of the base member 30. As the force urges the insert 46 deeper into the channel 34, the interaction of the sloping surfaces 56*a* and 56*b* with sloping surfaces 40*a* and 40*b* urges the sides of the insert 46 together gripping the rod more tightly.

It will be appreciated that, for a given pressure applied to the base member 30 by the pressure tube 60, the clamping force can be altered by changing the angle of surfaces 40*a* and 40*b* relative to the plane A-A. For example, a relatively shallow angle, such as 20 degrees, will produce more clamping force on the rod bed insert 46 than a relatively steeper angle, such as 40 degrees. Accordingly, depending on the specific application, the clamping effect can be tuned to achieve desired performance. For example, an application requiring light pressure on the metering rod may benefit from a relative steep angle of side walls 40*a* and 40*b* (greater clamping force at lower pressure on the metering rod), while an application requiring higher pressure on the metering rod may benefit from a more shallow angle (less clamping force at higher pressure on the metering rod).

Figure 4:
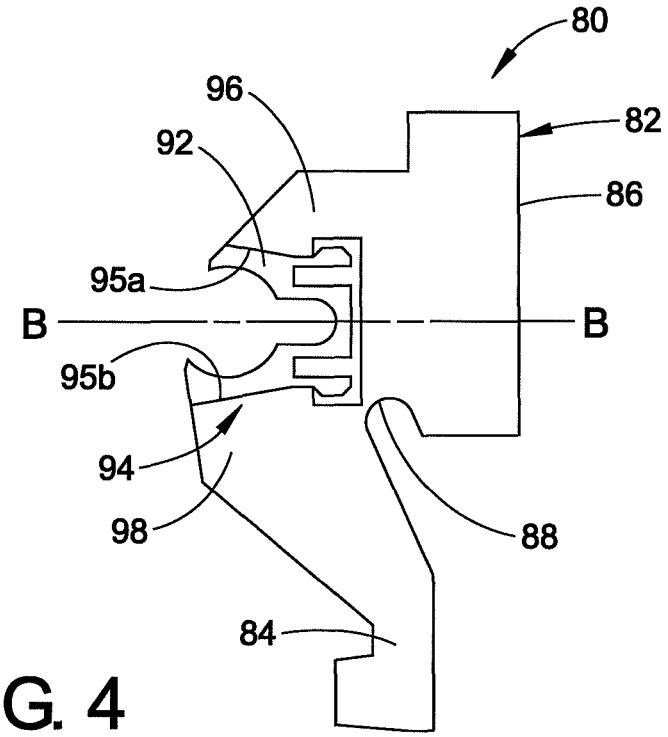
FIG. 4 is a cross-sectional view of another exemplary metering rod holder assembly in accordance with the present disclosure.

Turning to FIG. 4, another exemplary metering rod holder assembly is illustrated and identified generally by reference numeral 80. This embodiment is essentially identical to the metering rod holder assembly 10 of FIGS. 1-3, with the exception of a hinge feature of the base member. Accordingly, the assembly 80 includes a base member 82 having a mounting portion 84 adapted to be secured to a support (not shown), a head portion 86, and a reduced cross-section hinge portion 88 connecting the head portion 86 and the mounting portion 84. A rod bed insert 92 is received in a channel 94 of the base member 82 in a similar manner to the rod bed insert 46 of FIGS. 1-3. The channel 94 includes first and second side walls 95*a* and 95*b* spaced about an axis or plane B-B.

In this embodiment, the hinge portion 88 facilitates flexing of the head portion 86 relative to the mounting portion 84 when a force is applied to the head portion 86, such as by a pressure tube (e.g., pressure tube 60 of FIG. 1). Such flexing generally rotates the head portion 86 counterclockwise relative to the mounting portion 84 such that an upper jaw 96 including side wall 95*a* is urged towards a lower jaw 98 including side wall 95*b* thereby clamping the rod bed insert 92 and/or a metering rod in the channel 94 of the base member 82. In this embodiment, it may be advantageous to position the pressure tube to apply force to the head portion 86 at a position above plane B-B to increase the levering effect and clamping force generated.

As with the embodiment of FIGS. 1-3, the angle of side surfaces 95*a* and 95*b* relative to plane B-B can dictate the level of clamping force generated when the metering rod holder assembly is in use. Unlike the previous embodiment, however, the present embodiment optionally allows for elimination of the angled side walls of the channel 94 since the upper jaw 96 is urged towards lower jaw 98 resulting in a clamping effect independent of the clamping effect generated by angled side walls.

Figure 5:
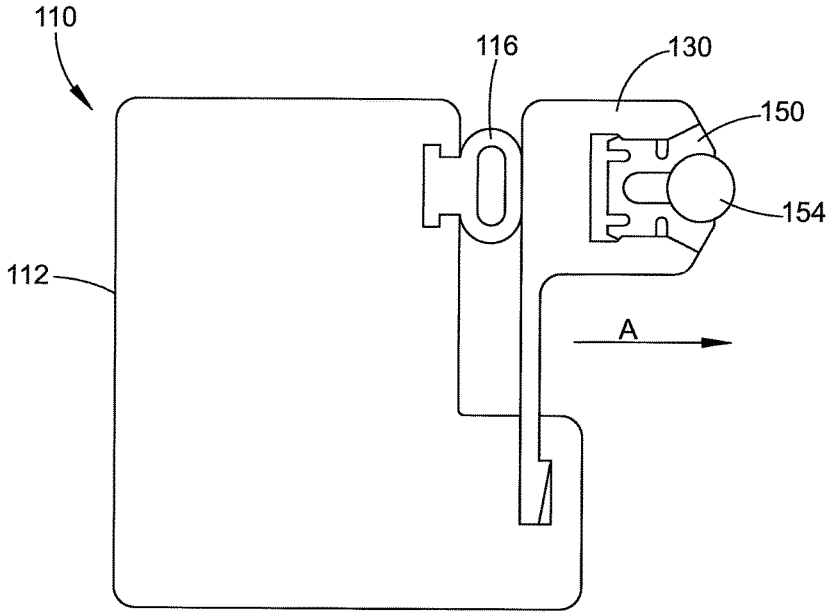
FIG. 5 is a side view of another exemplary metering rod holder assembly in accordance with the present disclosure.

Turning now to FIGS. 5-13, and initially to FIG. 5, another exemplary embodiment of a metering rod holder assembly in accordance with the present disclosure is illustrated and identified generally by reference numeral 110. It will be appreciated that the metering rod holder assembly 110 is supported by a support 112. The metering rod holder assembly 110 generally includes a base member 130 that is mounted to the support 112, and a rod bed insert 150 for receiving a metering rod 154. A loading hose 116 (e.g., a pressure tube) applies pressure in the direction of arrow A to force the metering rod 154 into engagement with a web of material other surface from which a coating or other liquid is to be metered. As will be appreciated, a coating is typically applied to the web of material or other surface (e.g., application roller) in excess, and the metering rod 154 is utilized to remove excess coating therefrom to achieve a desired coating thickness.

Figure 6A:
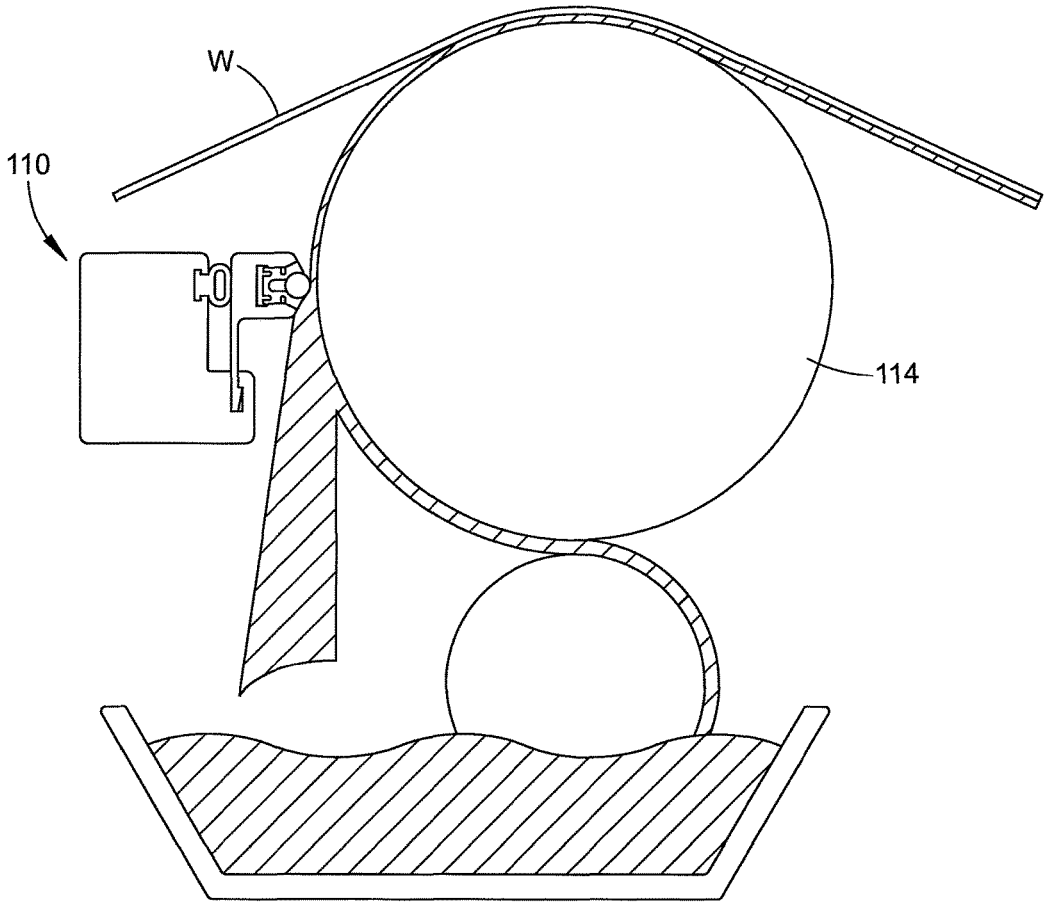
FIG. 6A is a side view of the exemplary metering rod holder assembly of FIG. 5 used in a transfer coating process.
Figure 6B:
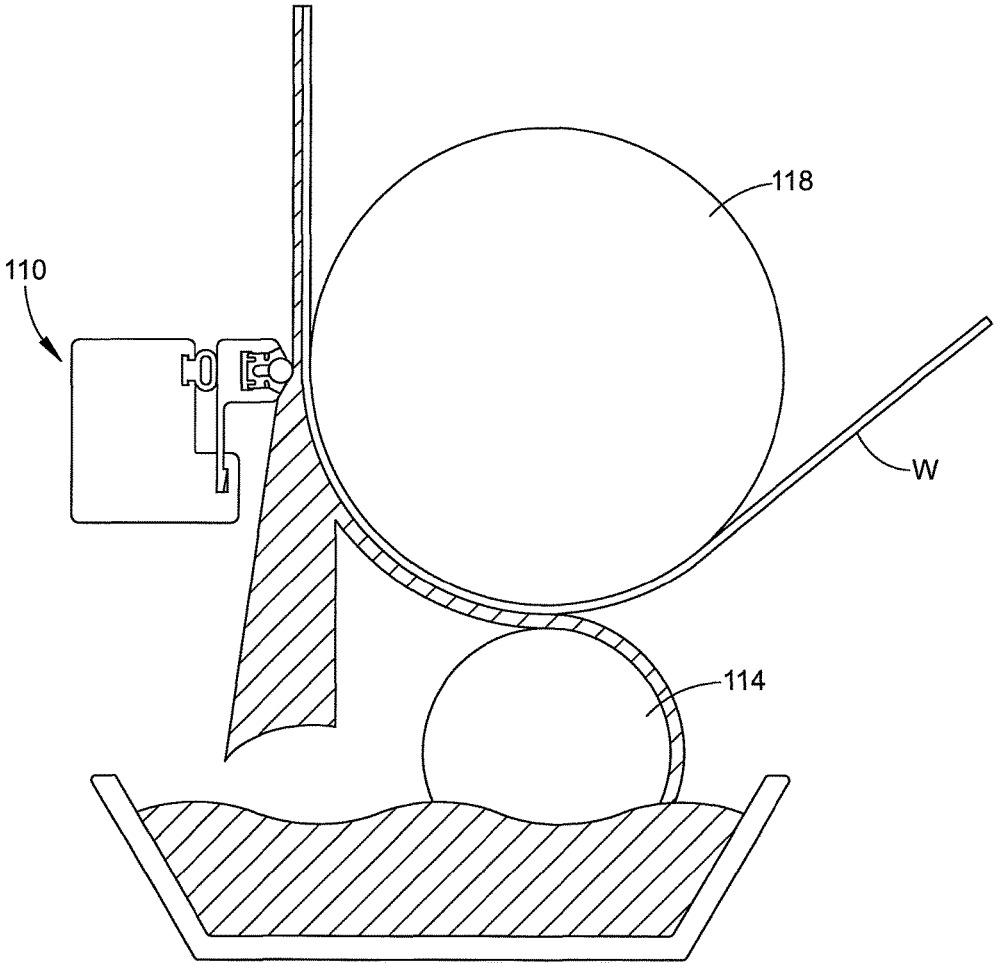
FIG. 6B is a side view of the exemplary metering rod holder assembly of FIG. 5 used in a backing roll coating process.
Figure 6C:
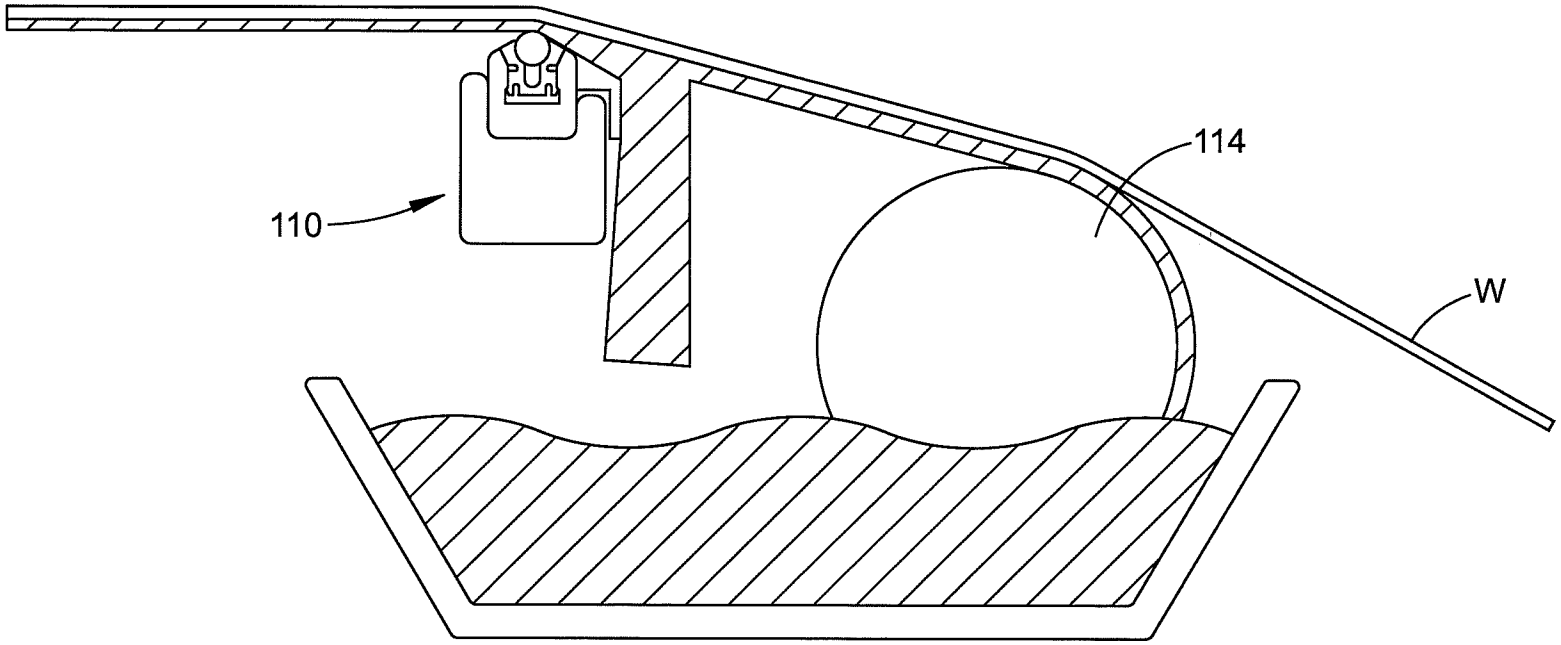
FIG. 6C is a side view of the exemplary metering rod holder assembly of FIG. 5 used in a direct web coating process.

For example, FIG. 6A illustrates the metering rod holder assembly 110 used in a transfer coating process where a coating is metered from an application roller 114 prior to the application roller 114 applying the coating to a web of material W. FIG. 6B illustrates the metering rod holder assembly 110 used in a backing roll coating process where a coating is first applied to the web of material W by an application roller 114, and then metered from the web of material W as the web of material W passes around backing roll 118. FIG. 6C illustrates the metering rod holder assembly 110 used in a direct web coating process where the coating is applied directly to the web of material W by application roller 114 and then metered from the web of material W without the use of a backing roll. It should be appreciated that aspects of the present disclosure are applicable to a wide range of applications where rods are used for metering a coating.

Figure 7:
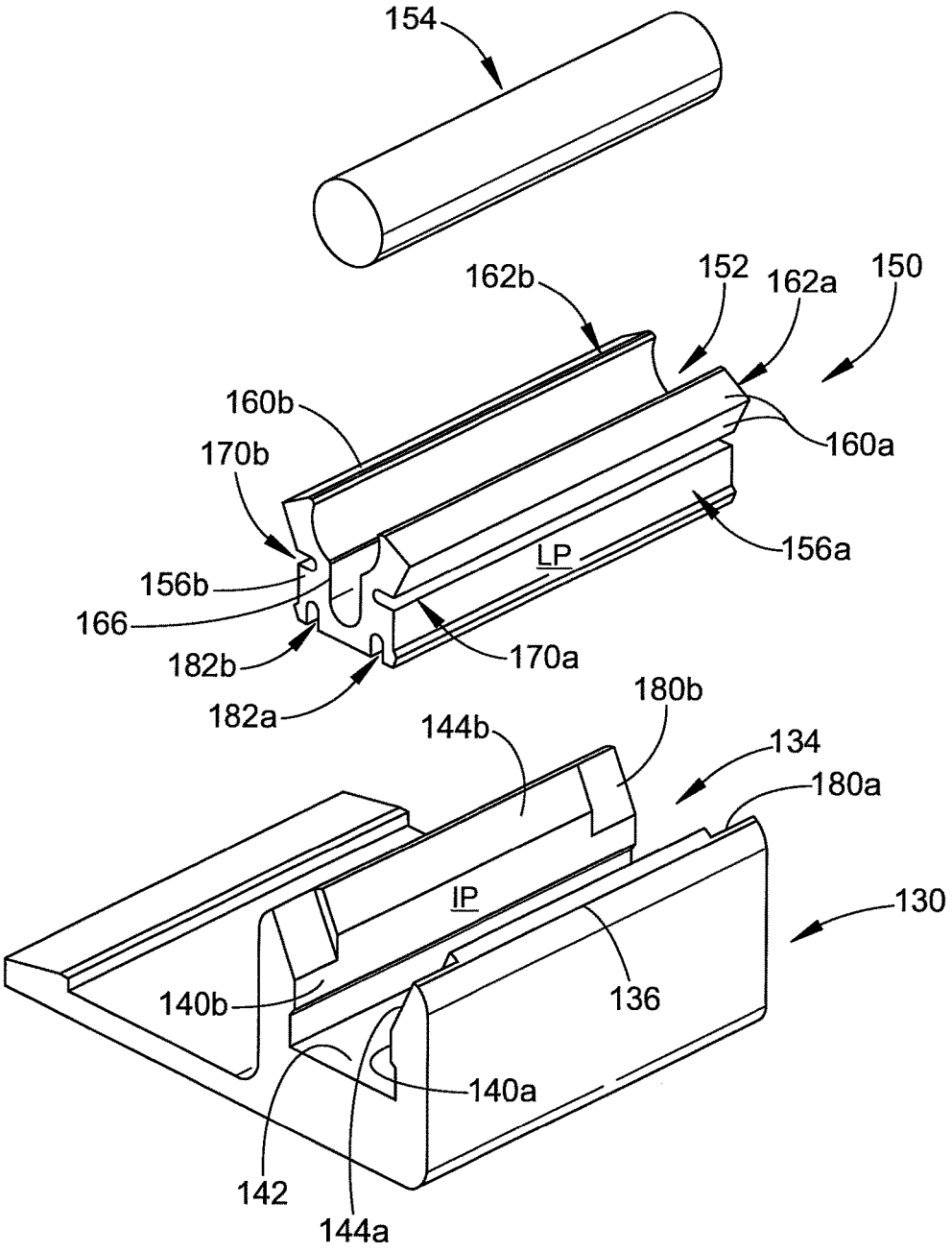
FIG. 7 is an exploded view of a rod bed insert and body of the metering rod holder assembly of FIG. 5.
Figure 8:
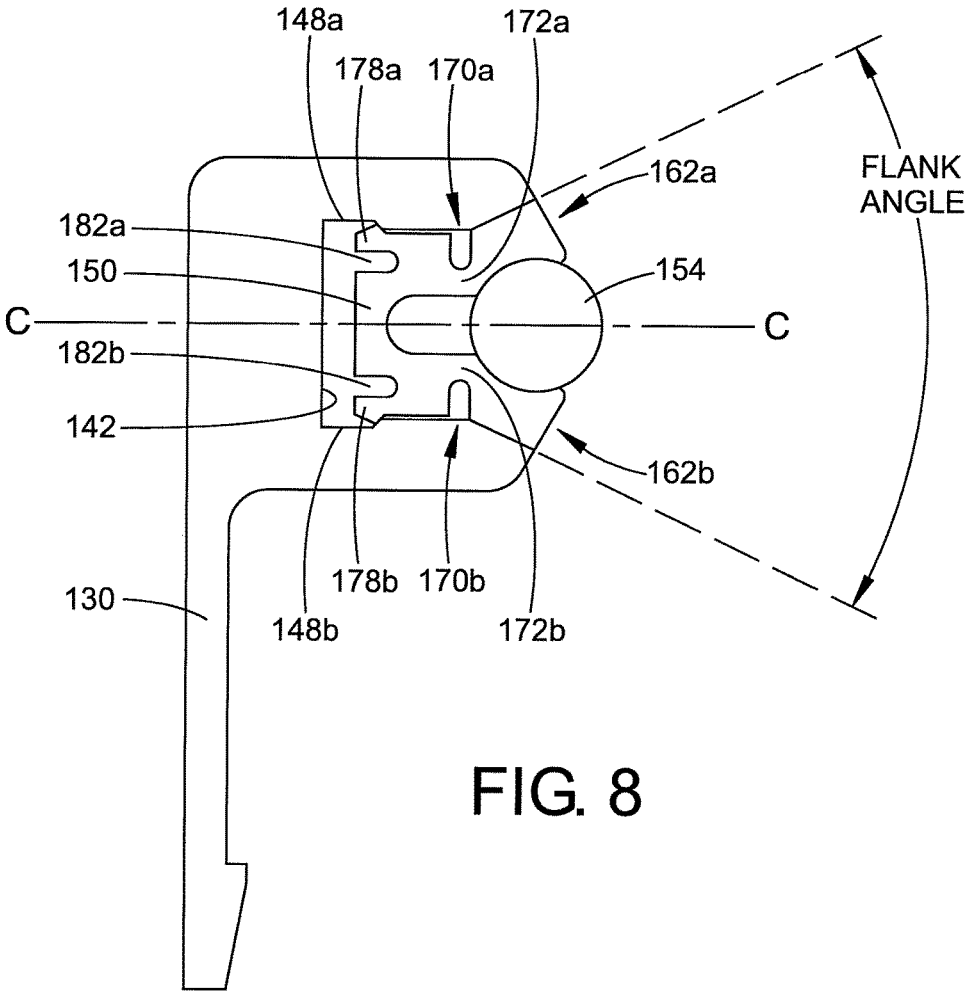
FIG. 8 is a cross-sectional view of the rod bed insert and body of the metering rod holder assembly of FIG. 5.

With additional reference to FIGS. 7 and 8, the base member 130 includes a channel 134 opening to a face or surface 136 thereof. The channel 134 is generally defined by first and second sidewalls 140*a* and 140*b* extending from a base wall 142. The first and second sidewalls 140*a* and 140*b* are spaced about a central plane C-C of the channel 134. In this embodiment, the first and second side walls 140*a* and 140*b* of the channel 134 each have an inner portion IP that extends from the base wall 142 parallel to the central plane C-C of the channel 134, and a beveled flank portion 144*a*/144*b* that extends at a non-zero angle relative to central plane C-C from the inner portion IP such that the mouth of the channel 134 is wider than a base portion of the channel 134. As shown in FIG. 8, the relative angle between the beveled flanks 144*a* and 144*b* is hereinafter referred to as the flank angle. The channel 134 further includes upper and lower retention slots 148*a* and 148*b* for receiving corresponding retention elements on the rod bed insert 150, as will be described below.

The rod bed insert 150 is received in the channel 134 and includes a metering rod slot 152 in which the metering rod 154 is configured to be supported. The rod bed insert 150 is configured to be closely received within the channel 134, with first and second sidewalls 156*a* and 156*b* of the insert 150 have a mating shape/configuration as the first and second side walls 140*a* and 140*b* of the channel 134. To this end, the first and second sidewalls 156*a* and 156*b* of the insert 150 each have a lower portion LP for abutting the inner portion IP of a respective sidewall 140*a*/140*b* of the channel 134, and a beveled flank engaging surface 160*a*/160*b* for engaging the beveled flanks 144*a*/144*b* of the sidewalls 140*a* and 140*b* of the channel 134.

The beveled flank engaging surfaces 160*a*/160*b* are surfaces of respective upper and lower jaws 162*a* and 162*b* that together at least partially define the rod slot 152. The jaws 162*a*/162*b* extend from a main body portion 166 of the rod bed insert 150. Longitudinally extending slots 170*a* and 170*b* define respective necked-down portions 172*a* and 172*b* between the main body portion 166 and the upper and lower jaws 162*a* and 162*b*. The necked-down portions 172*a* and 172*b* allow the jaws 162*a* and 162*b* to flex as the rod bed insert 150 is urged into the channel 134, as will be described in more detail below.

It should be appreciated that the magnitude of the flank angle, at least in part, generally has an inverse relationship between a force applied to the rod 154 by the loading hose 116/contact with an applicator roll 114 or other surface, and the amount of radial force applied to the metering rod 154 by the jaws 162*a*/162*b* of the rod bed insert 150. The lesser the flank angle, the greater the radial clamping force applied to the metering rod for a given constant application of force by the loading hose 116. Accordingly, the beveled flanks 144*a*/144*b* cooperate with the rod bed insert 150 to allow for a self-adjustment mechanism that generally adjusts the radial force applied to the metering rod 154 by the jaws 162*a* and 162*b* of the rod bed insert 150 as the rod bed insert 150 wears and seats further into channel 134, thus reducing or eliminating the need to provide other adjustment mechanisms and/or prolonging the useful life of the rod bed insert 150 by maintaining a desired radial force on the metering rod 154 as the rod bed insert 150 wears during normal use.

In some examples, the flank angle is between 100 and 220 degrees, more particularly between about 150 degrees and 170 degrees.

Figure 9:
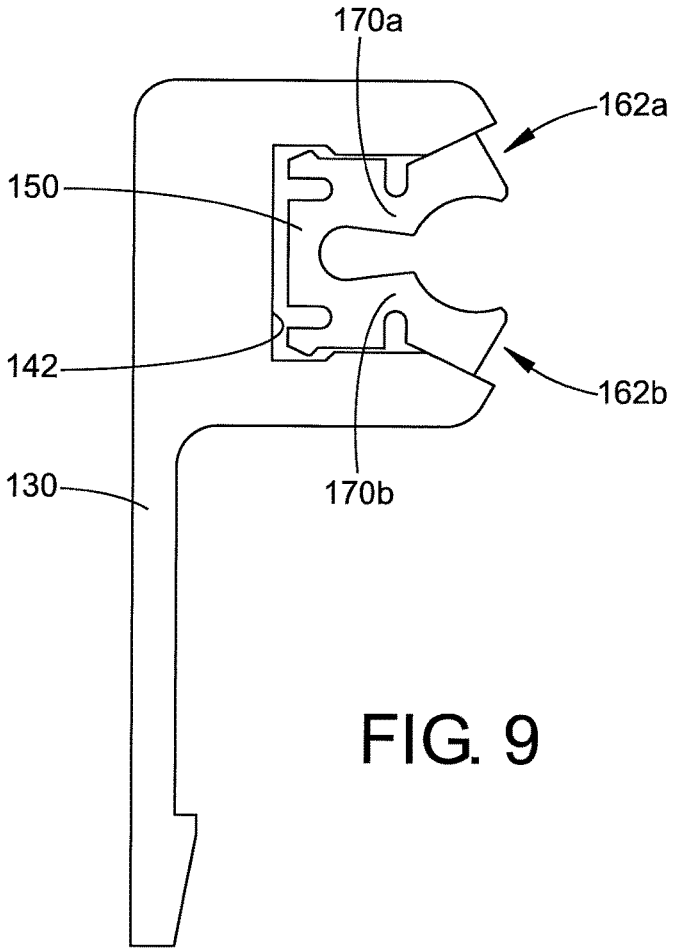
FIG. 9 is another cross-sectional view of the rod bed insert and body of the metering rod holder assembly of FIG. 5 in a slightly worn/fully seated condition.

In the illustrated embodiment, as the material (e.g., polymer) of the rod bed insert 150 wears out, the rod bed insert 150 will naturally seat further into the base member 130 as loading tube 116 applies constant pressure thereby maintaining a constant and/or more consistent clamping force on the metering rod 154 and enhancing performance. FIG. 9 illustrates the rod bed insert 150 in a slightly worn condition wherein it is further seated within the base member 130 as described. The jaws 162*a*/162*b* remain in contact with the beveled flanks 144*a*/144*b* along at least a major portion thereof thus providing even support to the rod bed insert 150. It should be appreciated that the metering rod 154 has been removed from FIG. 9 merely for illustrative purposes to show an exaggerated amount of movement of the jaws 162*a*/162*b*.

It should further be appreciated that the longitudinally extending slots 170*a* and 170*b* (e.g., flank relief cuts) can also be varied in size, depth, shape and/or location relative to the jaws 162*a* and 162*b* to customize the radial clamping force and/or relationship between the pressure applied by loading tube 116 and the clamping force, for certain applications.

The exemplary metering rod holder assembly 110 is designed such that the replaceable rod bed insert 150 can be snapped into the base member 130 from the top (e.g., inserted into the channel 134 in the vertical direction as shown in FIG. 6), or can slide in from the end of the base member 130 (e.g., longitudinally). Unlike some other designs, the rod bed insert 150 of the exemplary embodiment can be installed with or without a metering rod already installed because the jaws need not be initially compressed or otherwise distorted to be seated in the body. This ability to install the rod bed insert 150 with the metering rod 154 already installed cuts back on the costly time it takes to perform metering rod and rod bed insert change-outs in the field (e.g., a paper mill).

The rod bed insert 150 includes a pair of tab portions 178*a* and 178*b* that serve as retaining elements when the rod bed insert 150 is inserted in the channel 134. As best seen in FIGS. 7 and 8, the retention tabs 178*a* and 178*b* extend into corresponding retention slots 148*a* and 148*b* at the base of the channel 134. Slots 182*a*/182*b* facilitate inward flexing of tabs 178*a* and 178*b* when the rod bed insert 150 is forced into the channel 134. Once the tabs 178*a* and 178*b* are secured in the slots 148*a* and 148*b*, the interference between the tabs 178*a* and 178*b* and the base member 130 restricts withdrawal of the rod bed insert 150 from the channel 134. It will be appreciated that, as noted above, the retaining elements serve to secure the rod bed insert 150 within the base member 130 regardless of the manner in which the rod bed insert 150 is installed.

Figure 10:
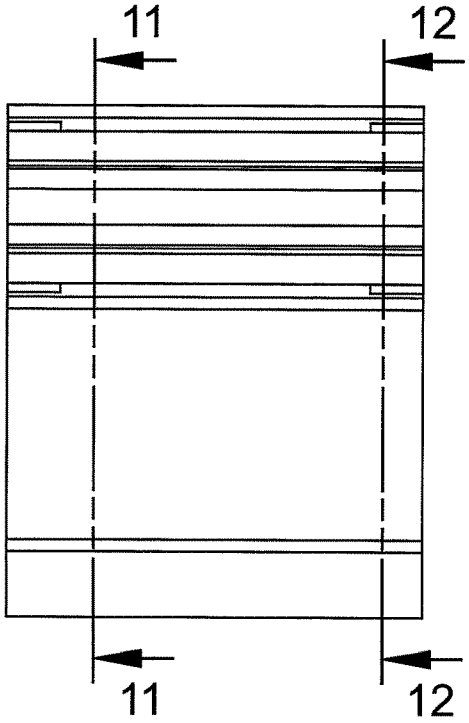
FIG. 10 is a side view of the rod bed insert and body of the metering rod holder assembly of FIG. 5.
Figure 12:
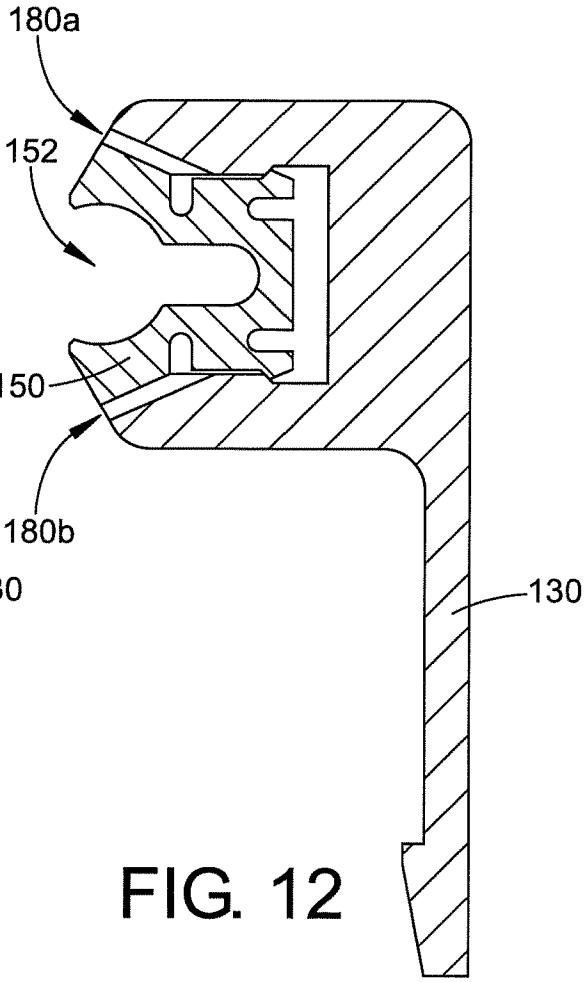
FIG. 12 is a cross-sectional view of the rod bed insert and body taken along the line 12-12 in FIG. 10.
Figure 11:
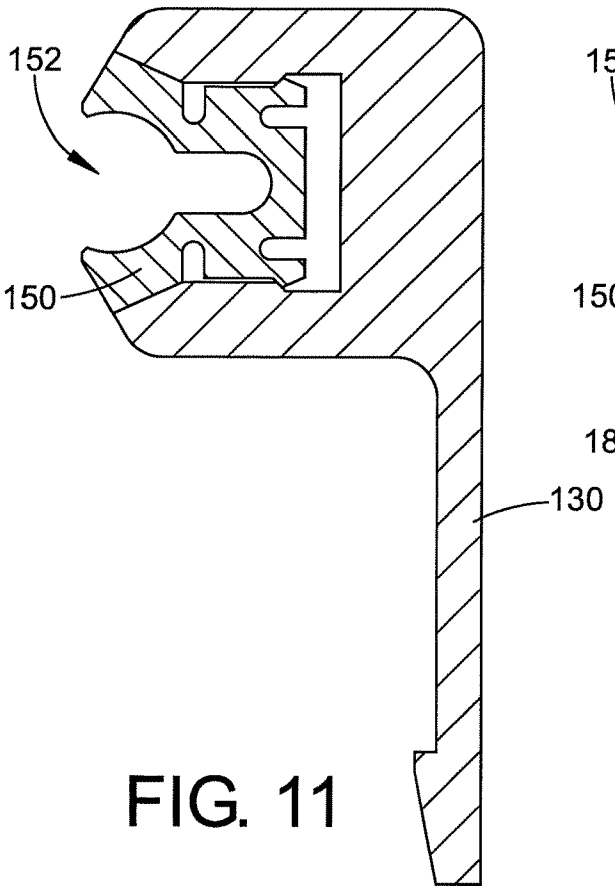
FIG. 11 is a cross-sectional view of the rod bed insert and body taken along the line 11-11 in FIG. 10.

With additional reference to FIGS. 10-12, the rod holder assembly 110 is illustrated in cross-section to highlight the presence of one or more relieved flank regions 180*a*/180*b* on each of the beveled flanks 144*a*/144*b*. It should be appreciated that rod bed inserts often wear out near the edges more quickly than throughout the rest of rod bed insert. This is most typically due to a lack of coating (which acts at a lubricant) at the edges of the web or applicator roll. This lack of lubricant causes excessive heat build-up due to friction which causes the rod bed insert material (e.g., polyethylene or polyurethane) to break down more quickly. By adding the relieved flank regions 180*a*/180*b* such that the rod bed insert 150 is not in contact with the base member 130 in specified areas (e.g., the ends of the metering rod), the amount of friction between the metering rod 154 and the rod bed insert 150 can be reduced. That is, the relieved flank regions 180*a*/180*b* reduce the amount of radial load on the metering rod 154 as compared to areas of the beveled flanks 144*a*/144*b* without the relieved flank regions 180*a*/180*b*, and also can allow the rod bed insert 150 to seat more fully into the base member 130 in the regions of the relieved flank regions 180*a*/180*b*. Although the relieved flank regions 180*a*/180*b* in the illustrated embodiment are only shown at terminal outer edges/portions of the beveled flanks 144*a*/144*b*, in some embodiments relieved flank regions can be provided at interior locations as desired. In addition, relief regions can be formed in the flank engaging surface of the rod bed insert 150 in addition to, or in the alternative to, the relieved flank regions 180*a*/180*b* of the base member 130. In some embodiments, the relieved flank regions can be spaced uniformly along the length of the rod bed insert and/or base member.

Figure 13:
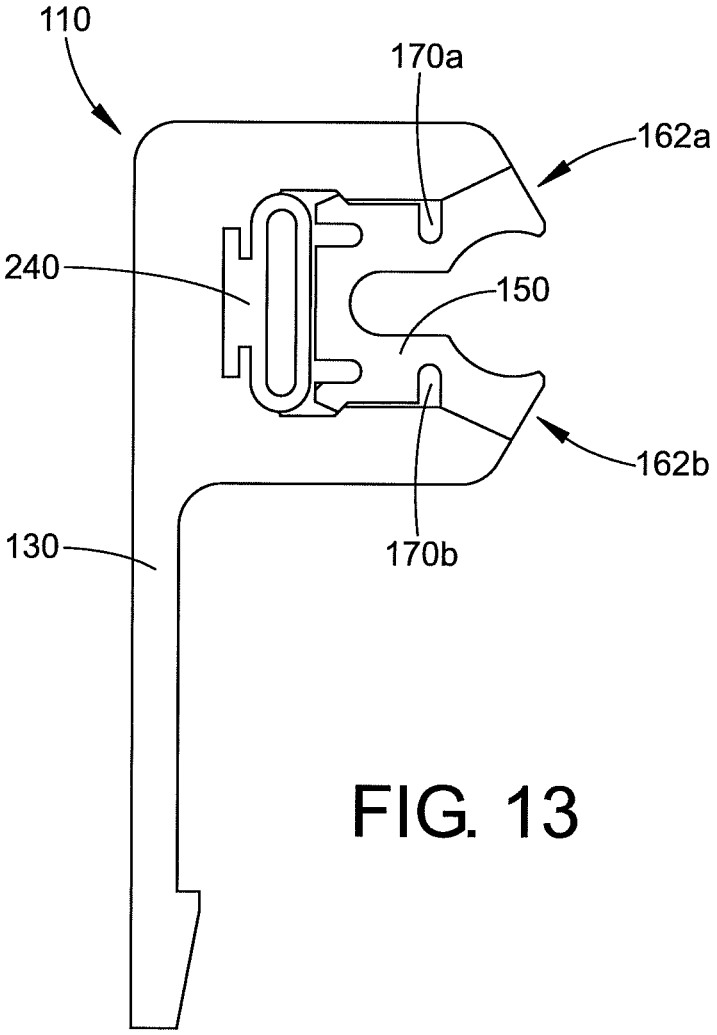
FIG. 13 is a side view of the rod bed insert and body of the metering rod holder assembly of FIG. 5 and further includes a loading tube.

Turning now to FIG. 13, an optional loading tube 240 is interposed between the base member 130 and the rod bed insert 150. The loading tube 240 can be used to urge the rod bed insert 150 outwardly from the base of the channel 134 to counteract the force pushing the insert into the base member 130, thereby reducing the amount of radial clamping pressure being applied to the metering rod 154. This can be used to offset an undesired increase in radial clamping pressure in certain applications, or in other situations when radial clamping force needs to be decreased. A further advantage of the loading tube 340 is that it can be used to force the rod bed insert 250 and metering rod 154 out of the channel 134 to facilitate rapid change-outs in the field.

The rod bed insert 150 is usually made of a single piece of machined polyethylene or cast polyurethane and is considered a consumable wear part. Using a two-piece assembly (e.g., base and rod bed insert) in accordance with the present disclosure allows for a smaller consumable portion of the metering rod holder assembly to reduce cost and waste.

Aspects of the present disclosure allow the rod bed insert 150 to be manufactured from certain flexible polymers that do not take a set (e.g., polyurethane). Accordingly, the rod bed inserts of the present disclosure can be coiled for shipping and uncoiled at a final destination by the end user. As compared to prior art rigid, straight rod bed inserts made of polyethylene that must be shipped in very long boxes (e.g., 40 feet), the rod bed inserts of the present disclosure offer significant saving from a shipping standpoint.

The exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A metering rod holder assembly for supporting an associated metering rod in compressive engagement with an associated surface from which a fluid is to be metered, the assembly comprising:

a base member having a channel opening to a first face thereof and having a base wall and first and second side walls spaced about a central plane of the channel, at least one of the side walls having a flank surface extending at a non-zero angle relative to the central plane; and a rod bed insert at least partially received in the channel of the base member in spaced relation to the base wall of the channel, the rod bed insert having a metering rod slot for receiving the associated metering rod, and further including a flank engaging surface thereof engaged with the flank surface, the rod bed insert movable from a first position to a second position within the channel during use with the associated metering rod received in the metering rod slot, wherein the rod bed insert is closer to the base wall of the channel when in the second position than when in the first position;

wherein the rod bed insert is configured to be received in the channel, the first and second side walls of the insert having a mating shape to the first and second side walls of the channel;

wherein at least one of the flank surface of the base member or the flank engaging surface of the rod bed insert includes a relieved flank region;

wherein the rod bed insert is spaced apart from the flank surface of the base member at the relieved flank region; and wherein a plurality of relieved flank regions are spaced along a length of the metering rod holder assembly, including opposite end portions of the metering rod holder assembly.

2. The metering rod holder assembly as set forth in claim 1, wherein at least one of the first and second side walls of the channel extend at a non-zero angle relative to the central plane of the channel in a taper fit manner, whereby as the metering rod urges the rod bed insert deeper into the channel the first and second side walls of the base member clamp the rod bed insert in the channel.

3. The metering rod holder assembly as set forth in claim 1, further comprising a pressure hose disposed in the channel between the base wall and the rod bed insert for urging the rod bed insert outwardly from the channel.

4. The metering rod holder assembly as set forth in claim 1, wherein the rod bed insert includes at least one retaining element adapted to cooperate with a corresponding retaining element of the base member to restrict separation of the metering rod insert from the base member in both the first position and the second position.

5. The metering rod holder assembly as set forth in claim 4, wherein the retaining elements include at least one protrusion and at least one recess into which the protrusion is received.

6. The metering rod holder assembly as set forth in claim 1, wherein at least one of the base member or the rod bed insert is comprised of a resilient material.

7. The metering rod holder assembly as set forth in claim 1, wherein the flank engaging surface is a portion of a jaw extending from a main body portion of the rod bed insert, the rod bed insert including a longitudinally extending slot between the main body portion and the jaw for allowing the jaw to flex as the rod bed insert is urged into the channel.

8. A rod bed insert for an associated metering rod holder assembly adapted to move relative to a base member of the associated metering rod holder assembly to provide a consistent radial clamping pressure on an associated metering rod as the rod bed insert wears during use, the rod bed insert configured to be received in a channel of the base member of the associated metering rod holder assembly, the rod bed insert comprising a metering rod slot for receiving the associated metering rod, and a flank engaging surface for engaging a corresponding flank surface of the base member of the associated metering rod holder assembly, the rod bed insert movable from a first position to a second position within the channel during use with the associated metering rod received in the metering rod slot, wherein the rod bed insert is closer to the base wall of the channel when in the second position than when in the first position;

wherein the flank engaging surface includes a relieved flank region;

wherein the rod bed insert is spaced apart from the flank surface of the associated base member at the relieved flank region; and further comprising a plurality of relieved flank regions spaced along a length of the flank engaging surface including at opposite end portions of the rod bed insert.

9. A base member for a metering rod holder assembly comprising a channel opening to a first face thereof for receiving an associated rod bed insert, the channel having a base wall and first and second side walls spaced about a central plane of the channel, at least one of the side walls having a flank surface extending at a non-zero angle relative to the central plane, wherein the associated rod bed insert can be at least partially received in the channel of the base member in spaced relation to the base wall of the channel, wherein the flank surface includes a plurality of relieved flank regions spaced apart along a length of the base member, including at opposite end portions of the base member.

10. The base member of claim 9, wherein at least one of the first and second side walls of the channel extend at a non-zero angle relative to the central plane of the channel in a taper fit manner.

11. The base member of claim 10, wherein the associated rod bed insert is spaced apart from the flank surface of the base member at the relieved flank regions.

* * * * *